United States Patent [19]

Busnelli

[11] 4,135,264

[45] Jan. 23, 1979

[54] DIVAN OR EASY CHAIR CONVERTIBLE INTO A MADE BED

[75] Inventor: Ambrogio Busnelli, Milan, Italy

[73] Assignee: B & B Italia S.p.A., Milan, Italy

[21] Appl. No.: 818,458

[22] Filed: Jul. 25, 1977

[30] Foreign Application Priority Data

Sep. 17, 1976 [IT] Italy ..... 27337 A/76

[51] Int. Cl.[2] ..... A47C 17/10

[52] U.S. Cl. ..... 5/45; 5/43

[58] Field of Search ..... 5/13, 18, 44 R, 47

[56] References Cited

U.S. PATENT DOCUMENTS

| | | | |
|---|---|---|---|
| 169,976 | 11/1875 | Fifield | 5/45 |
| 2,731,650 | 1/1956 | Gopert | 5/44 R |
| 2,866,982 | 1/1959 | Purves, Jr. | 5/45 |
| 3,088,130 | 5/1963 | Walstad | 5/44 R |
| 3,952,344 | 4/1976 | Cycowicz et al. | 5/13 |

*Primary Examiner*—Casmir A. Nunberg

*Attorney, Agent, or Firm*—Kurt Kelman

[57] ABSTRACT

A convertible couch comprises a mobile, spring supporting frame mounted on a fixed base and extending between two like lateral frames of the base. The mobile frame is divided into two frame parts having a length not exceeding the length of the lateral base frames and an intermediate frame part therebetween which has a length less than the height of the lateral base frames. The frame parts are interconnected by hinges so that the intermediate frame part may be pivoted in relation to a first one of the frame parts and a second one of the frame parts may be pivoted in relation to the intermediate frame part through an angle not exceeding 90° about axes extending parallel to the head board of the couch. The intermediate and second frame parts are pivotal between a folded and a "bed" position, the first and second frame parts extending parallel to each other and being spaced apart by the intermediate frame part in the folded position, and all three frame parts extending in a plane projecting perpendicularly to the head board in the "bed" position. In the "bed" position, each of the first and second frame parts are supported by independent supports connected to the respective frame parts.

9 Claims, 8 Drawing Figures

A
2b
2c
3
3'
4
4'
5
6
8
2a
18

B
C
D
1
1a
1b
2
2a
2b
2c
3
5
6
7
8
8a
8b
9
10
11
11a
11b
12
13
13a
14
15
16
17
18
18a
18b
18c
19

P
1
1a
1b
2a
2b
2c
3"
4"
5
6
7
8
8a
8b
9
9a
10
11
11a
11b
12
13
13a
14
15
16
17
18
18a
18b
18c
19

DIVAN OR EASY CHAIR CONVERTIBLE INTO A MADE BED

The present invention concerns a couch or easy chair convertible into a made bed, i.e. comprising the sheets, blankets, padded quilt and the like, in which the mattress with its associated accessories is folded only once, whilst it is not necessary to remove the cushions of the seat and/or back, the movement of the parts which are folded being effected by means of a hinge of limited movement and without the use of levers, guides, slides or the like.

As is well known, there are various types of couches or easy chairs convertible into a single or double bed in a direction perpendicular to the back. They have many disadvantages, among which the main ones are constituted by the presence of numerous levers, guides, connecting rods, slides and the like for controlling the movement of the various parts, which movement is derived from a lifting action, rotation or the like of a part of the couch, the lever systems being necessarily disposed at the outer sides of the frame carrying the supporting base of the mattress and the seats and/or within the arms, occupying a considerable amount of space and being difficult to operate.

Another considerable disadvantage of known types of convertible couches is due to the necessity of removing the cushions forming the seat, and sometimes even removing the back or the cushions thereof when it is being transformed into a bed. Other disadvantages of the known types are constituted by the large amount of space occupied by the couch in its position as a bed, due to the distance of the head end from the supporting wall, with the necessity of reducing the length of the bed and of folding two or three times the mattress and the associated accessories. What may be considered as a further disadvantage of many known types of convertible couches is the fact that this article of furniture has no space to contain pillows or cushions which then have to be removed to a position away from the couch when it is closed. Other disadvantages are due to the presence of levers, bars or the like on a level with the supporting frame of the mattress which generally make their presence felt through the mattress and the like. The couch or easy chair convertible into a bed according to the present invention at least substantially reduces all these disadvantages and also has a bearing structure which works as a support both in its condition as a divan and in that of a bed, including the arms.

According to the present invention there is provided a divan or easy chair convertible into a made bed, comprising a fixed side frame and a displaceable network or mesh base supporting frame, the latter being divided into three parts, two parts of which are longer than the intermediate part, connected together by hinged joints, the assembly of the supporting frame being carried by the fixed frame on two hinged joints, one of which is disposed on the upper front end of the fixed frame and situated between the two hinges of the intermediate part, and the other disposed on the rear part of the fixed frame by means of a pivotable connecting rod, the joint between the intermediate part and the long part, extending towards the end of the base carrying frame, being formed by a hinge having a limited movement through approximately 90°.

It will thus be seen that in accordance with preferred embodiments of the present invention, the couch comprises a fixed frame substantially constituted by a rectangle, each side of which, comprising sections, tubular rods or the like, the lateral dimensions of which equal the width of the couch and reach almost the height of the seat, a fixed hinge being connected to the front end of each frame. The supporting frame of the base and the seat of the divan is divided lengthwise into three parts, of which two long ends, of a length substantially equal to the depth of the couch correspond to the head and foot of the bed, and a short intermediate part of length equal to the thickness assumed by the mattress folded only once, comprise the accessories of the bed such as sheets, blankets and the like, the three parts being connected together by a hinge having a limited movement at the foot of the bed and a normal movement at the other end.

Pivoted on the fixed hinge, connected to the side frames supporting the divan, is the long part of the base carrying frame extending towards the foot of the bed and becoming disposed in a position intermediate between the two hinges of the base carrying frame when the bed is opened out. The other long part of the frame, extending towards the head of the bed, is supported at the free end by a pivotable connecting rod pivoted on an end of the fixed frame and at the other end on the long part of the base supporting frame.

Connected to said long part of the base supporting frame, at the foot end is a frame forming the support of the armrest, which frame also supports the feet of the long part of the base supporting a frame. As stated, the pivoted connection of the intermediate length of the base frame to the long part thereof extending towards the foot end, is formed by a hinge having a limited movement in both directions through an angle substantially close to 90°, so that in one limiting position, the two parts of the frame, short and long, are in alignment and in the other limited position, they are at an angle of approximately 90°. The other hinge, connecting at each end the intermediate part with the long part at the head of the base frame is of normal type without any devices limiting movement.

According to the invention, it is therefore sufficient to rotate from one position to the other, to approximately 180°, the long part of the base frame, by which rotation the hinge having a movement limiting device, upon reaching a stop, rotates the intermediate part, bringing it into alignment with the preceding part and the intermediate part, by way of the associated hinge, drives the long part at the head end of the frame, producing, together with the pivotable connecting rod and with the fixed frame, an articulated polygon.

During this movement, the long part at the head end of the base frame is gradually raised, remaining horizontal until it comes into alignment with the intermediate part and that at the foot end when both have reached the horizontal position.

The support of the displaceable end on the floor is effected by a suitable foot on the arm frame. The padded part of the seat and back of the divan, as also the padding of the arms, remain firmly applied to said base frame even in the conversion into a bed, remaining enclosed in the part between the arms which becomes turned down towards the floor, thus making it unnecessary to displace any member before the conversion.

Furthermore a space is also provided under the back in which it is possible to place cushions or pillows in the folded position.

In order to facilitate the opening and closing movement, springs may be provided counterbalanced on said pivotable connecting rod in the lifting direction on other suitable parts, whilst a reversible prop may also be provided driven by a spring in the opening direction of the bed in order to produce an intermediate support for the open bed so as to eliminate the stress on the second hinge and on the intermediate part of the base frame, which would otherwise operate suddenly on the hinge at the limit of opening.

The invention will be further illustrated, by way of example, with reference to the accompanying drawings, in which.

Figure 1:
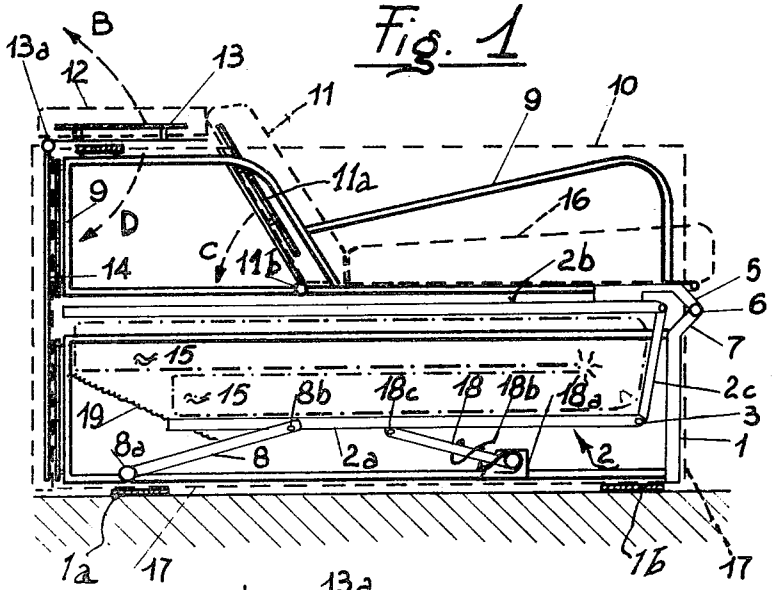
FIG. 1 is a side view of a couch, in the closed position with cushions indicated in broken lines.

With reference to FIG. 1, the couch is shown in a closed position formed by two fixed, preferably rectangular, lower side frames of a base 1, which frames have a length corresponding to the depth of the couch and a height slightly less than the surface of the seat.

The rectangular side frames of the base 1 comprise a spring supporting frame indicated by 2, divided into three parts, of which a first part is indicated by 2*a*, a second part is indicated by 2*b* and an intermediate short part is indicated by 2*c*, the intermediate part being hinged to the other two parts by two hinges 3 and 4.

The intermediate part 2*c* has a length substantially equal to twice the thickness of a mattress including such accessories as sheets, blankets, padded quilts and the like.

The assembly of the three parts forming the base supporting frame 2 is supported at the front by an arm 5, by way of a hinge 6 disposed at the end of an arm 7 connected to the fixed frame 1, and at the rear by a swinging connecting rod 8 pivoted on the lower end 8*a* by a horizontal rod of the fixed frame 1 and at the upper end 8*b* by the part 2*a* of the base supporting frame 2.

The hinges 3 and 4 permit folding of the three parts of the frame 2, first and second parts 2*a* and 2*b* being superposed and parallel with each other, and; spaced apart by intermediate part 2*c* as shown in FIG. 1. The part 2*b* carries, connected therewith, a fixed frame 9 for forming and supporting the arm rest 10, the back 11 and a padded head rest 12, the last three formed by padded cushions or the like with their own coverings. The back 11 is supported by frame 11*a* hinged on the frame 9 at the point 11*b* and bearing on a frame 13 which supports the padding of head rest 12 and is hinged at 13*a* to a head board 14 connected to the base frame 1.

Within the base supporting frame 2, closed as in FIG. 1, is the mattress 15, folded once over itself, complete with bedding accessories (not shown). Above the part 2*b* of the base supporting frame 2, is the seat 16, formed by one or more padded cushions with its own covering, supported by the spring stretched on the frame 2 (shown partially in FIG. 3). The base frame 1 is covered by padded lining 17, similar to the covering of the arm rests 10 disposed thereon.

The hinge 4, disposed between the part 2*b* of the foot end and the intermediate part 2*c* of the base carrying frame 2, is formed by an articulation permitting an angular movement, limited by stops, through an angle of approximately 90°, the limiting positions of which are determined by the position of alignment between the part 2*b* and the part 2*c* when opened and by the angular position of approximately 90° between the parts when closed.

Figure 4:
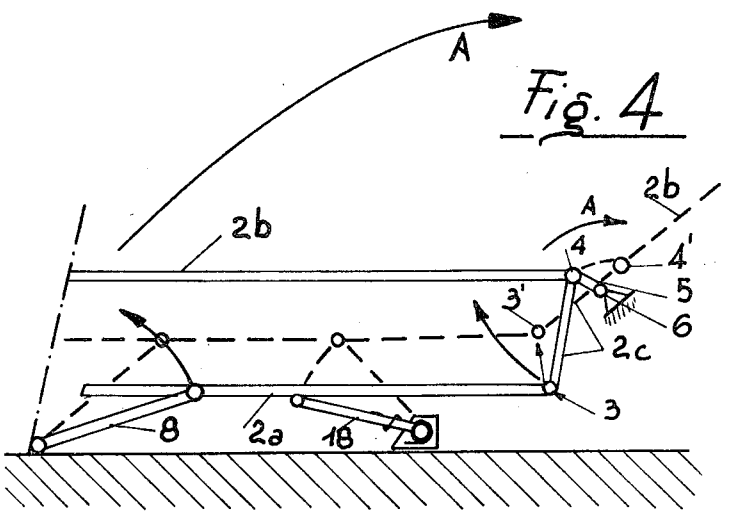
FIG. 4 is a schematic view of an intermediate position obtained during the opening of the couch to convert it into a made bed.

As may be seen from the Figures, particularly from FIG. 1, the hinge 6 which supports the front of the frame 2, is connected to the arm 7 fixed to the frame 1, and hence it is shown in the diagram of the kinetic mechanism in FIG. 4, as a fixed point around which the part 2*b* rotates with an upward movement indicated by the arrow A.

Figure 2:
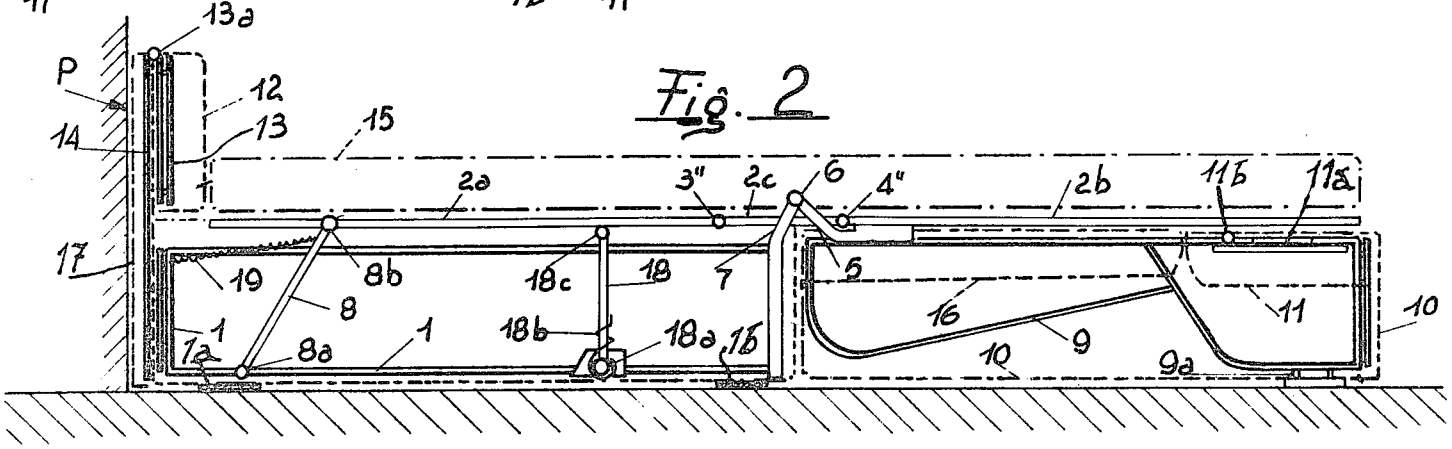
FIG. 2 is a side view of the same couch in its position as a bed.
Figure 3:
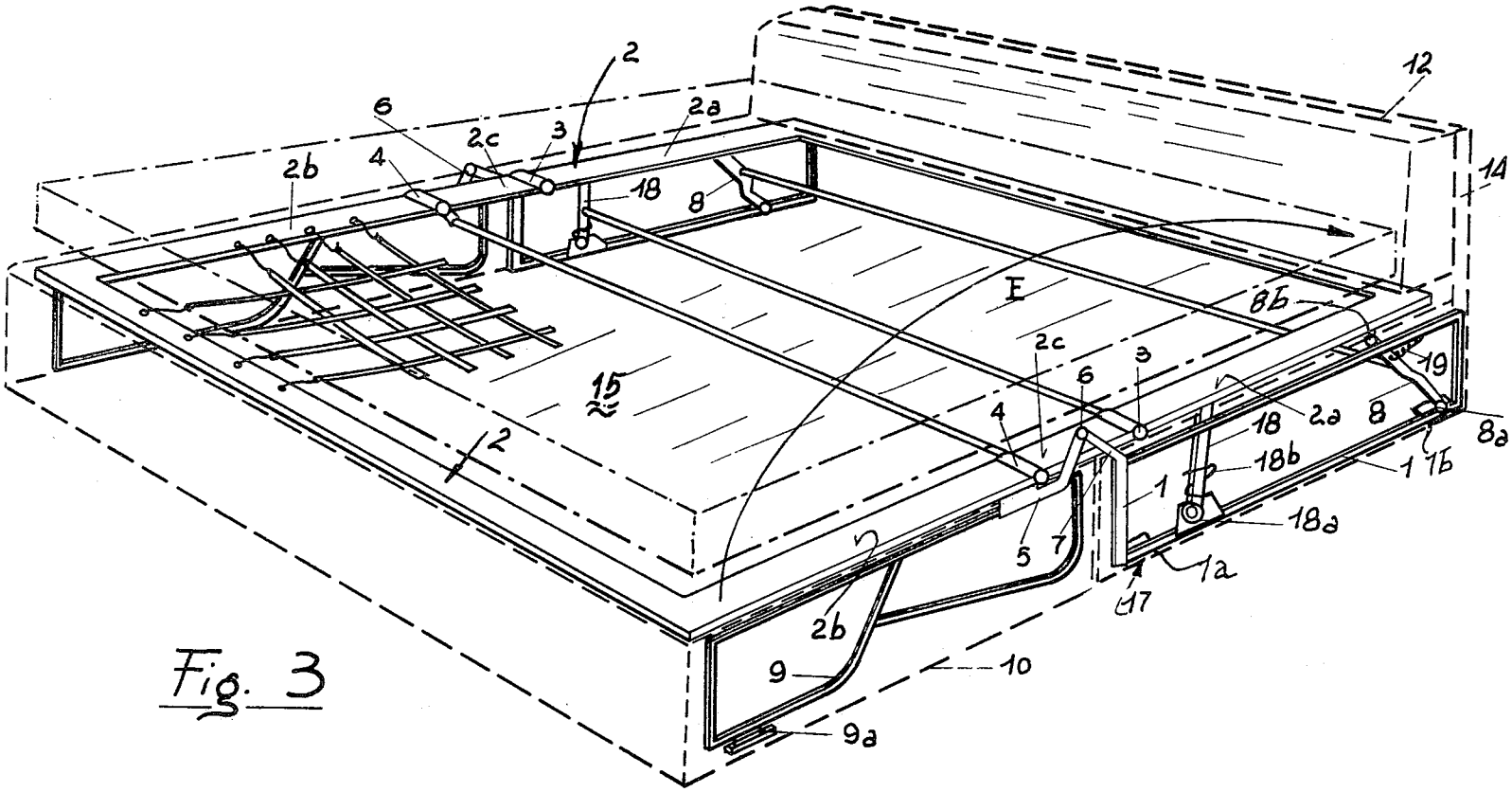
FIG. 3 is a perspective and schematic view of the couch in the open position of FIG. 2.

With reference to FIGS. 2 and 3, the couch is shown in the position of an already open bed and it is possible to see the parts 2*a*, 2*b* and 2*c* of the frame 2 in alignment with each other on which the mattress 15 rests completely extended, whilst the frame 9 forming the padded arm rests 10, is supported on the floor by two feet 9*a* connected to the frame 9.

Similarly, the frame 1 rests on the floor by means of feet 1*a* and 1*b* connected thereto.

Operation of the couch is as follows:

Referring to FIG. 1, the couch in its closed state is shown as a normal sitting room settee, with its sides and front closed by padding 17, with side arm rests 10, associated cushions 16, back 11 and rear cushion 12. The entire base supporting frame 2 is folded inwardly between the base frame 1 and encloser, as stated, the bedding 15.

In order to convert the couch into a bed, firstly the cushion 12 with the frame 13 is raised in the direction of the arrow B, pivoting on the hinge 13*a*. Then the back 11 with the frame 11*a* is turned down, rotating it on the pivot 11*b* in the direction of the arrow C, until it bears on the frame 2*b* where it remains secured by resilient means or the like. At this point, the entire upper unit formed by the part 2*b* of the frame 2, the frame 9 with arm rests 10, back 11 and seat 16, is displaced upwardly in the direction of the arrow A (FIG. 4) rotating with the arm 5 about the fixed hinge 6.

In the first part of this movement, the hinge 4, having a limited movement, permits the angular opening of the part 2*b* relatively to 2*c* and rotates about the hinge 6, raising the part 2*c*. The latter, by way of the hinge, 3, raises the part 2*a* and pivots the connecting rod 8, an articulated polygon which forms a link of the fixed side of which is formed by the frame 1 and the arm 7 with end hinges 6 and 8*a*, and the displaceable connecting rods being formed by the rod 8, the part 2*a*, the part 2*c* and the arm 5.

Therefore the part 2*a* is raised, whilst the part 2*c* tends to align itself with the part 2*b*. When, by continuing the rotation in the direction A, the part 2*c* becomes aligned with 2*b*, it remains locked in the aligned position and continues, together with the part 2*b*, to rotate about the fixed hinge 6, whereby the hinge 3 is forced to rise from intermediate position 3' to the position 3'' in which the parts 2*a*, 2*c* and 2*b* are aligned horizontally. In this position, the foot 9*a* connected to the frame 9, rests on the floor, and the connecting rod 8 acts as an end support for the part 2*a* of the frame 2. The mattress 15, connected to the frame 2, is also extended, whilst the padded head rest 12 is lowered by rotating it about the hinge 13*a* in the direction of the arrow D, so as to form the head of the bed C.

As may be seen from FIG. 2, the entire lateral and front width of the bed remains completely closed, whilst the head of the bed is very close to the vertical wall P without being subjected to any displacement.

The base supporting frame member 2a, resting at the end 8b on the connecting rod 8 is supported at the other end by the hinge 3 connected to the intermediate part 2c supported by the part 2b by way of the limited movement hinge 4. However, in order to improve the stability of the part 2a, a prop 18 may be provided, hinged on the fixed frame 1 at 18a urged by a spring 18b to rotate upwardly and adapted to support, by the end 18c, the underside of the frame part 2a. At the end of the rising movement, the prop 18a becomes disposed in a vertical position and acts as a support for the part 2a, releasing the intermediate part 2c from powerful stresses which might act on the hinge 4.

Compensating means are also provided to assist the raising of the assembly, such as the spring 19 for acting on the connecting rod 8 or similar return means applied at any suitable point.

For the movement from the bed position to the couch position, the reverse operations are effected, raising the end of the part 2b of the frame and rotating it in the direction of the arrow E (FIG. 3). In this manner the hinge 4 permits the initial rotation through approximately 90° relatively to the part 2c, when, having reached the permitted limit, it drives the latter in movement with the lowering of the part 2a until returning to the resting position shown in FIG. 1.

Cushions, pillows or other accessories which cannot be contained between the parts of the folded mattress 15 may be disposed within the upper space formed below the back 11 and the head rest 12.

The above description concerning a couch convertible into a bed, in this case a double bed, also applies to an arm chair convertible into a single bed, the sole difference being constituted by the width dimensions.

It will be understood that many variations of construction particularly regarding the accessories and the movement members may be applied thereto without departing from the scope of the present invention.

What we claim is:

1. A couch or easy chair convertible into a bed, which comprises a. a head board, b. a fixed base including two like lateral frames extending from the head board, each of the lateral frames having a length and a height, c. a mobile, spring supporting frame mounted on the base and extedning between the two lateral base frames, the mobile frame being divided into three parts, 1. a first one and a second one of the mobile frame parts having a length not exceeding the length of the lateral base frames,
2. an intermediate one of the mobile frame parts between the first and second frame parts, the intermediate frame part having a length less than the height of the lateral base frames,
3. a first hinge means interconnecting the first and intermediate frame parts and permitting the intermediate frame part to be pivoted in relation to the first frame part about an axis extending substantially parallel to the head board, and
4. a second hinge means interconnecting the intermediate and second frame parts and permitting the second frame part to be pivoted in relation to the intermediate frame part about an axis extending substantially parallel to the head board, the second hinge means being arranged to limit the pivoting of the second frame part to an angle not exceeding about 90°, the intermediate and second frame parts being pivotal about the first and second hinge means between a folded position, wherein the first and second frame parts extend substantially parallel to each other and are spaced apart by the intermediate frame part extending substantially parallel to the head board, and a "bed" position, wherein the three frame parts extend substantially in a plane projecting substantially perpendicularly to the head board, and d. independent support means for supporting each of the first and second frame parts in the "bed" position, each of the support means being connected to a respective one of the frame parts.

2. The convertible couch or easy chair of claim 1, further comprising a mattress folded once between the first and second frame parts in the folded position and extending substantially flat over the spring supported on the three substantially planar frame parts in the "bed" position.

3. The convertible couch or easy chair of claim 1, wherein the support means for the second frame part comprises a pair of arm rests mounted on the second frame part adjacent the two lateral base frames.

4. The convertible couch or easy chair of claim 3, further comprising a back rest mounted pivotally on the second frame part for pivoting about an axis extending substantially parallel to the head board between an upright position and a position substantially parallel to the second frame part.

5. The convertible couch or easy chair of claim 4, further comprising a head rest mounted pivotally on the head board for pivoting between a position substantially parallel to the head board and a position projecting therefrom towards the back rest in the upright position thereof, the back rest resting against the head rest in the projecting and upright positions.

6. The convertible couch or easy chair of claim 1, further comprising a fixed pivot means supported on the base and having a pivot axis extending substantially parallel to the axis of the second hinge means between the second hinge means and the first hinge means, and a pivotal arm means connecting the second frame part to the fixed pivot means, the fixed pivot means permitting the pivotal arm means to pivot the second frame part about the axis thereof while the second frame part is pivoted about the axis of the second hinge means into planar alignment with the intermediate frame part, and the pivoting of the pivotal arm means raising the first frame part until the frame parts are in the "bed" position.

7. The convertible couch or easy chair of claim 6, wherein the support means for the first frame part comprises linking rod means having respective ends pivoted to the fixed base and the first frame part.

8. The convertible couch or easy chair of claim 7, wherein the support means for the first frame part further comprises a prop means having respective ends pivoted to the fixed base and the first frame part, the prop means being mounted between the linking rod means and the first hinge means and being spring biased from a lowered position into an upright position.

9. The convertible couch or easy chair of claim 1, further comprising counterbalancing spring means arranged to assist the pivotal movements between the folded and "bed" position.

* * * * *